US009915420B2

(12) United States Patent
Woytowitz et al.

(10) Patent No.: US 9,915,420 B2
(45) Date of Patent: Mar. 13, 2018

(54) ILLUMINATING DEVICE WITH SEALED OPTICS

(71) Applicant: Hunter Industries, Inc., San Marcos, CA (US)

(72) Inventors: Peter J. Woytowitz, San Diego, CA (US); Darrin I. Schmuckle, Vista, CA (US)

(73) Assignee: Hunter Industries, Inc., San Marcos, CA (US)

( * ) Notice: Subject to any disclaimer, the term of this patent is extended or adjusted under 35 U.S.C. 154(b) by 204 days.

(21) Appl. No.: 14/860,620

(22) Filed: Sep. 21, 2015

(65) Prior Publication Data

US 2017/0051910 A1 Feb. 23, 2017

Related U.S. Application Data

(60) Provisional application No. 62/208,428, filed on Aug. 21, 2015.

(51) Int. Cl.

| | |
|---|---|
| ***F21V 31/00*** | (2006.01) |
| ***F21V 29/76*** | (2015.01) |
| ***F21K 99/00*** | (2016.01) |
| *F21Y 101/02* | (2006.01) |

(52) U.S. Cl.

CPC ..... *F21V 31/005* (2013.01); *F21K 9/1375* (2013.01); *F21V 29/763* (2015.01); *F21Y 2101/02* (2013.01)

(58) Field of Classification Search

CPC ..... F21K 9/237; F21K 9/238; F21K 9/232; F21K 9/1375; F21V 31/005; F21V 29/763

See application file for complete search history.

(56) References Cited

U.S. PATENT DOCUMENTS 9,476,580 B2 * 10/2016 Treurniet ..... F21K 9/238
2011/0267834 A1 * 11/2011 Potucek ..... F21S 8/00 362/551

* cited by examiner

*Primary Examiner* — Karabi Guharay

(74) *Attorney, Agent, or Firm* — Knobbe Martens Olson & Bear, LLP

(57) ABSTRACT

An illuminating device can include a housing having one or more sidewalls defining a housing interior. The device can include at least one light element and an optics assembly. The optics assembly can include an outer face and at least one lens. The at least one lens can be configured to allow light from the at least one light element to pass therethrough. The optics assembly can include a skirt extending from the outer face into the housing interior and surrounding the at least one lens. The skirt can have an interior surface defining a skirt interior and an outer surface facing the one or more sidewalls of the housing. Potting material can be positioned between the outer surface of the skirt and the one or more sidewalls to prevent water ingress into the skirt interior. In some cases, no potting material is positioned within the skirt interior.

20 Claims, 9 Drawing Sheets

FIG 1.D

ILLUMINATING DEVICE WITH SEALED OPTICS

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

TECHNICAL FIELD

Certain embodiments discussed herein relate to devices and systems for providing lighting in indoor and/or outdoor settings.

DISCUSSION OF THE RELATED ART

Lighting fixtures are commonly used to provide lighting to indoor and/or outdoor environments. Outdoor lighting fixtures in particular can be subject to environmental hazards such as condensation, humidity, temperature variance, dirt, sand, dust, and sunlight. Often times, certain components of lighting fixtures can be especially vulnerable to damage when subject to environmental hazards. Illuminating devices, such as an incandescent light bulb, are often replaceably installed in a light fixture that provides the power connections, additional protection, and aesthetic features to create a functional luminaire.

SUMMARY

An illuminating device can include a housing having a first end, a second end, and one or more sidewalls defining a housing interior. The device can include an optics assembly. The optics assembly can include a first portion. In some embodiments, the optics assembly includes a skirt connected to the first portion. The skirt can have an interior surface defining a skirt interior. In some embodiments, the optics assembly includes one or more lenses, at least one of the one or more lenses positioned at least partially within the skirt interior. The illuminating device can include a light assembly having at least one light element positioned within the housing interior adjacent one or more lenses. The skirt can be sealed against another portion of the illuminating device to inhibit or prevent ingress of moisture into the skirt interior. In some embodiments, the illuminating device includes a potting material. In some embodiments, the potting material is positioned between the outer surface of the skirt and the one or more sidewalls to prevent (e.g., or further prevent) water ingress into the skirt interior. In some cases, no potting material is positioned within the skirt interior.

According to some variants, an illuminating device includes a housing having a first end, a second end, and one or more sidewalls defining a housing interior. The device can include an optics assembly. The optics assembly can be connected to the housing at near the first end of the housing. The optics assembly can include a first portion having a first side and a second side. In some embodiments, the optics assembly includes, a skirt connected to the first portion and extending from the second side of the first portion, the skirt having an interior surface defining a skirt interior and an outer surface facing the one or more sidewalls of the housing. In some embodiments, the optics assembly includes one or more lenses. At least one of the one or more lenses can be positioned at least partially within the skirt interior. Each of the one or more lenses can have a first end and a second end positioned further from the first portion of the optics assembly than the first end of the one or more lenses. The illuminating device can include a light assembly. The illuminating assembly can be positioned at least partially within the housing interior. The light assembly can have a circuit board. The circuit board can be positioned within housing interior. In some embodiments, the light assembly includes at least one light element. The light element can be operably connected to the circuit board. In some embodiments, the light element is positioned within the housing interior adjacent the first end of the one or more lenses. In some cases, the illuminating device includes a potting material. In some embodiments, the skirt is connected to one or both of the circuit board and the one or more sidewalls. In some cases, the potting material is positioned between the outer surface of the skirt and the one or more sidewalls to prevent water ingress into the skirt interior. In some embodiments, no potting material is positioned within the skirt interior.

In some embodiments, the illuminating device includes a plurality of lenses, wherein each of the plurality of lenses is positioned within the skirt interior.

In some embodiments, the illuminating device includes a second skirt connected to the first portion and extending from the second side of the first portion, the second skirt having an interior surface defining a skirt interior and an outer surface facing the one or more sidewalls of the housing, wherein at least a second one of the one or more lenses is positioned within the skirt interior of the second skirt.

In some embodiments, the optics assembly comprises one or more alignment structures configured to mate with a corresponding alignment on a component of the illuminating device.

In some embodiments, circuit board includes one or more alignment structures configured to couple with the one or more alignment structures of the optics assembly.

In some embodiments, the one or more alignment structures of the optics assembly comprises pins and the one or more alignment structures of the circuit board comprises holes configured to receive the pins of the optics assembly.

In some embodiments, the first portion of the optics assembly includes a fill hole through which the potting material can be injected between the outer surface of the skirt and the one or more sidewalls.

In some embodiments, the illuminating device includes one or more vents configured to facilitate egress of displaced air from between the outer surface of the skirt and the one or more sidewalls as potting material is injected between the outer surface of the skirt and the one or more sidewalls.

In some embodiments, the at least one light element is mounted on the circuit board.

In some embodiments, the housing includes an internal wall separating the housing interior into a first housing chamber and a second housing chamber, wherein the at least light element is positioned in the first housing chamber and the circuit board is positioned in the second housing chamber.

In some embodiments, the illuminating device includes a control board configured operably connected to the circuit board and to a source of power.

According to some variants, an illuminating device includes a housing having a first end, a second end, and one or more sidewalls defining a housing interior. In some embodiments, the illuminating device includes at least one light element positioned within the housing interior. The device can include an optics assembly connected to the first end of the housing. The optics assembly can include an outer face. In some embodiments, the optics assembly includes at least one lens extending from the outer face into the housing interior and having a first end opposite the outer face that is adjacent the at least one light element. The at least one lens can be configured to allow light from the at least one light element to pass therethrough. In some embodiments, the optics assembly includes a skirt extending from the outer face into the housing interior and surrounding the at least one lens. The skirt can have an interior surface defining a skirt interior and an outer surface facing the one or more sidewalls of the housing. In some embodiments, the illuminating device includes a potting material positioned between the outer surface of the skirt and the one or more sidewalls to prevent water ingress into the skirt interior, and wherein no potting material is positioned within the skirt interior.

In some embodiments, the optics assembly is a monolithic part constructed from a transparent or translucent material.

In some embodiments, the potting material is an opaque material.

In some embodiments, the illuminating device comprises a power interface assembly coupled with the housing. The power interface assembly can include an interface housing. In some embodiments, the power interface assembly includes one or more contact pins positioned at least partially within the interface housing and configured to connect to a source of power.

According to some variants, an illuminating device comprises a housing having a first end, a second end, and one or more sidewalls defining a housing interior. In some embodiments, the illuminating device includes at least one light element positioned within the housing interior. The device can include an optics assembly. The optics assembly can be positioned at least partially within the housing interior. In some embodiments, the optics assembly includes an outer face. The optics assembly can include at least one lens. The at least one lens can be positioned adjacent the at least one light element. In some embodiments, the at least one lens is configured to allow light from the at least one light element to pass therethrough. The optics assembly can include a skirt extending from the outer face into the housing interior and surrounding the at least one lens. The skirt can have an interior surface defining a skirt interior and an outer surface facing the one or more sidewalls of the housing. In some embodiments, the device includes a sealing structure connected to the skirt. In some embodiments, the sealing structure forms a seal between the skirt and another structure of the illuminating device. In some embodiments, no potting material is positioned within the skirt interior.

In some embodiments, the at least one lens is positioned between the at least one light element and the outer surface of the optics assembly.

In some embodiments, the sealing structure forms a hermetic seal between skirt and another structure of the illuminating device to inhibit or prevent fluid ingress into the skirt interior.

In some embodiments, the sealing structure forms a hermetic seal between the skirt and a circuit board.

In some embodiments, the housing includes one or more fins configured to increase the convective area of the housing to dissipate heat to an ambient environment

BRIEF DESCRIPTION OF THE DRAWINGS

The present disclosure is described with reference to the accompanying drawings, in which like reference characters reference like elements, and wherein:

FIG. 1D illustrates a front view of the illuminating device of FIG. 1A.

DETAILED DESCRIPTION

Figure 1A:
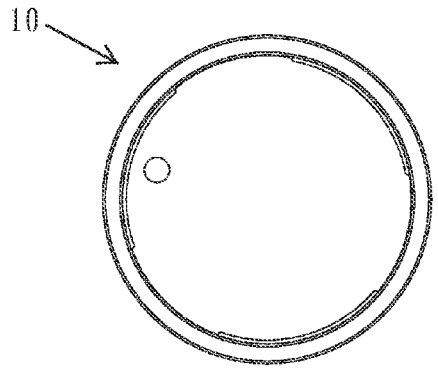
FIG. 1A illustrates a top view of an embodiment of an illuminating device.
Figure 1B:
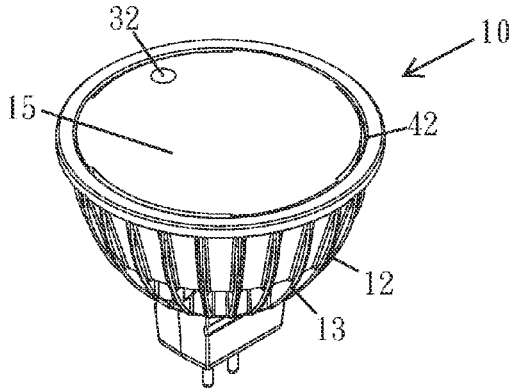
FIG. 1B illustrates a perspective view of the illuminating device of FIG. 1A.
Figure 1C:
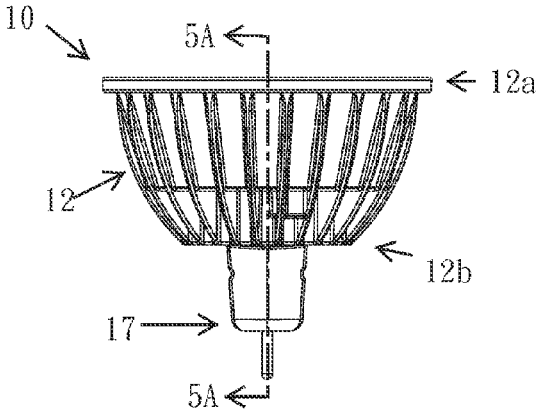
FIG. 1C illustrates a side view of the illuminating device of FIG. 1A.
Figure 1E:
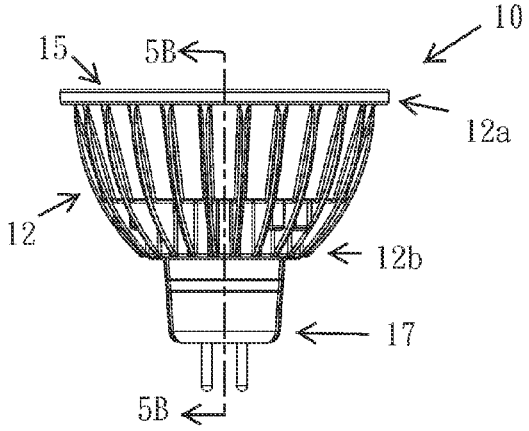
FIG. 1E illustrates a bottom view of the illuminating device of FIG. 1A.
Figure 1E:
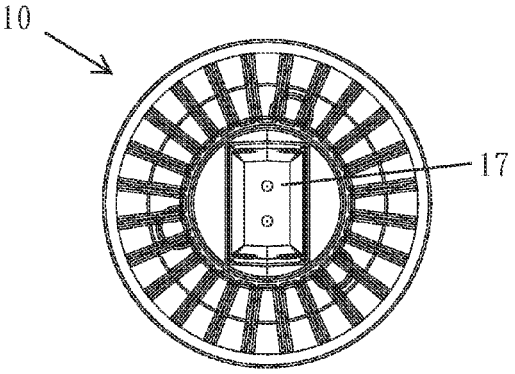

FIGS. 1A-1E illustrate an embodiment of an illuminating device (e.g., luminaire) 10. In some cases, the term illuminating device is used interchangeable with the terms lighting fixture or light fixture. The illuminating device 10 can include a housing 12. The housing 12 can have a first end 12*a* and a second 12*b*. In some embodiments, an optics assembly 15 is connected to the housing 12 (e.g., at or near the first end 12*a* of the housing 12). The illuminating device 10 can include a power interface assembly 17. In some embodiments, the power interface assembly 17 is connected to the second end 12*b* of the housing 12. The illuminating device 10 can be, for example, a total internal reflection illuminating device. Examples of total internal reflection devices include, but are not limited to MR-16, MR-11, MR-20, MR-8, and MR-10 illuminating devices. These devices are intended to be removeably installed in corresponding lighting fixtures that provide appropriate protection, aesthetic properties, and power connections for the lamp.

Figure 2:
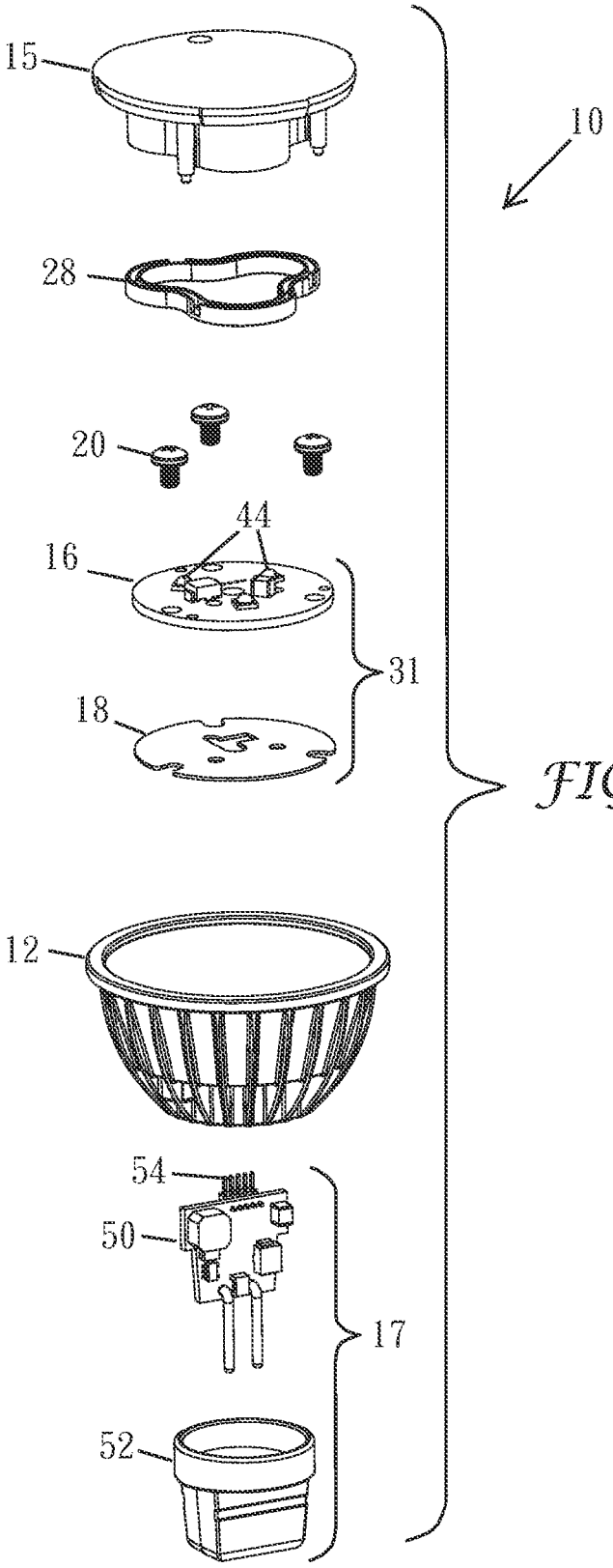
FIG. 2 illustrates an exploded view of the illuminating device of FIG. 1A.

As illustrated in FIG. 2, the illuminating device 10 can include a light assembly 31. The light assembly 31 can be sized and shaped to fit at least partially within the housing 12. In some embodiments, the light assembly 31 includes one or more light elements 44, such as, for example, LEDs or other light elements. The light elements 44 can be attached to a circuit board 16. In some embodiments, the light assembly 31 includes a conductive pad 18 (e.g., a thermally conductive plate). The light assembly 31 can be positioned between the power interface assembly 17 and the optic assembly 15 in the assembled illuminating device 10. In some embodiments (not shown), the light assembly 31 does not include a circuit board. In some such embodiments, the light elements 44 are electrically connected to a source of power and to some portion or component of the illuminating device 10.

The power interface assembly 17 can include an interface housing 52. In some embodiments, the power interface assembly 17 includes electrical components. For example, the power interface assembly 17 can include a control board 50. The control board 50 can be configured to connect directly or indirectly with the circuit board 16 of the light assembly 31. In some embodiments, the circuitry (e.g., electrical components) of the control board 50 and circuit board 16 are integrated into a single circuit board (not shown). This integrated circuit board may be positioned in any portion of the illuminating device 10 (e.g., the power interface assembly 17, the housing interior 23, the skirt interior, etc.). In some embodiments, the integrated circuit board is positioned outside of the illuminating device 10.

The housing 12 can be formed from a heat conducting material such as, for example, zinc. In some embodiments, the housing may be formed from a heat conducting plastic. In some embodiments, the housing 12 is coated with an electrophoretic coating or other coating to provide improved aesthetic qualities, thermal conductivity, and/or to increase resistance to environmental elements. As illustrated in FIGS. 3A-3D, the housing 12 can include a sidewall 19. In some embodiments, the sidewall 19 comprises a wall extending around a perimeter of the housing 12. The sidewall 19 can define a housing interior 23. The sidewall 19 can taper between the first end 12*a* of the housing 12 and the second end 12*b* of the housing 12. For example, the sidewall 19 can have a larger cross-sectional area at the first end 12*a* of the housing 12 than at the second end 12*b* of the housing 12 (FIG. 3B). In some embodiments, the housing 12 includes one or more heat-dissipating elements. For example, one or more fins 13 can be formed on an outer surface of the housing 12. The one or more fins 13 can extend along all or a portion of the housing 12 between the first and second ends 12*a*, 12*b* of the housing 12. The one or more fins 13 may increase the conductive and/or convective area to the atmosphere to increase thermal transfer of the heat generated in the illuminating device 10 to help transfer heat away from the electronic components.

Figure 3A:
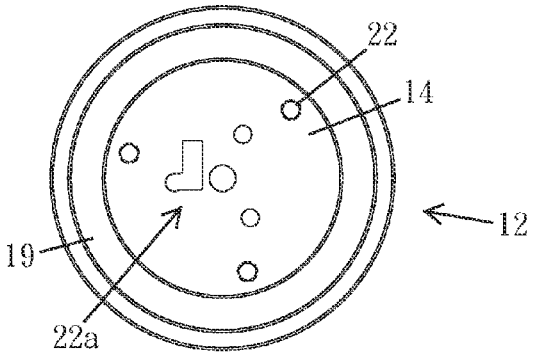
FIG. 3A illustrates a top view of a housing of the illuminating device of FIG. 1A.
Figure 3D:
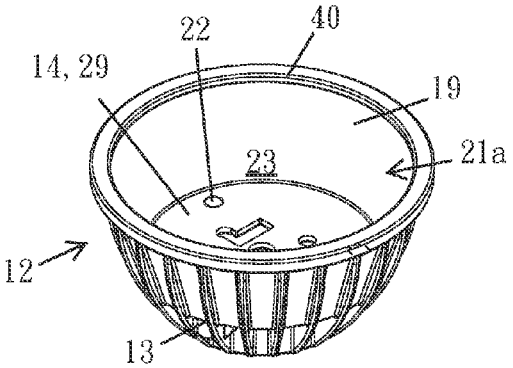
FIG. 3D illustrates an upper perspective view of the housing of the illuminating device of FIG. 1A.
Figure 3B:
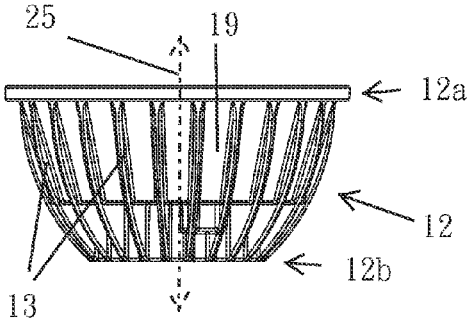
FIG. 3B illustrates a side view of the housing of the illuminating device of FIG. 1A.
Figure 3C:
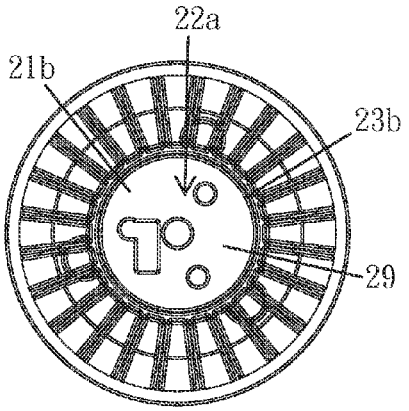
FIG. 3C illustrates a bottom view of the housing of the illuminating device of FIG. 1A.

The housing 12 can include a first opening 21*a* at the first end 12*a* of the housing 12 (FIG. 3D). In some embodiments, the housing 12 includes a second opening 21*b* at the second end 12*b* of the housing 12 (FIG. 3C). The first opening 21*a* can be larger than the second opening 21*b*. In some embodiments, the first and send openings 21*a*, 21*b* are approximately the same size. In some applications, the first opening 21*a* is smaller than the second opening 21*b*.

In some embodiments, the housing 12 includes an interior divider or wall 29. The interior wall 29 can be positioned within the housing interior 23 between the first and second ends 12*a*, 12*b* of the housing 12. The interior wall 29 can be generally perpendicular to an axis 25 (FIG. 3B) of the illuminating device 10. The interior wall 29 can include one or more apertures through a thickness of the interior wall 29. The apertures can be configured to permit passage of electronics or other components (e.g., wires, circuit board components, fasteners) through the interior wall 29. For example, as illustrated in FIGS. 3A-3D, the interior wall 29 can include one or more fastener apertures 22 and/or one or more electrical apertures 22*a*. The fastener apertures 22 can be threaded or otherwise configured to engage with a fastener. In some embodiments, the interior wall 29 includes a first mounting surface 14. The first mounting surface 14 of the interior wall 29 can generally face the first end 12*a* of the housing 12.

Figure 5A:
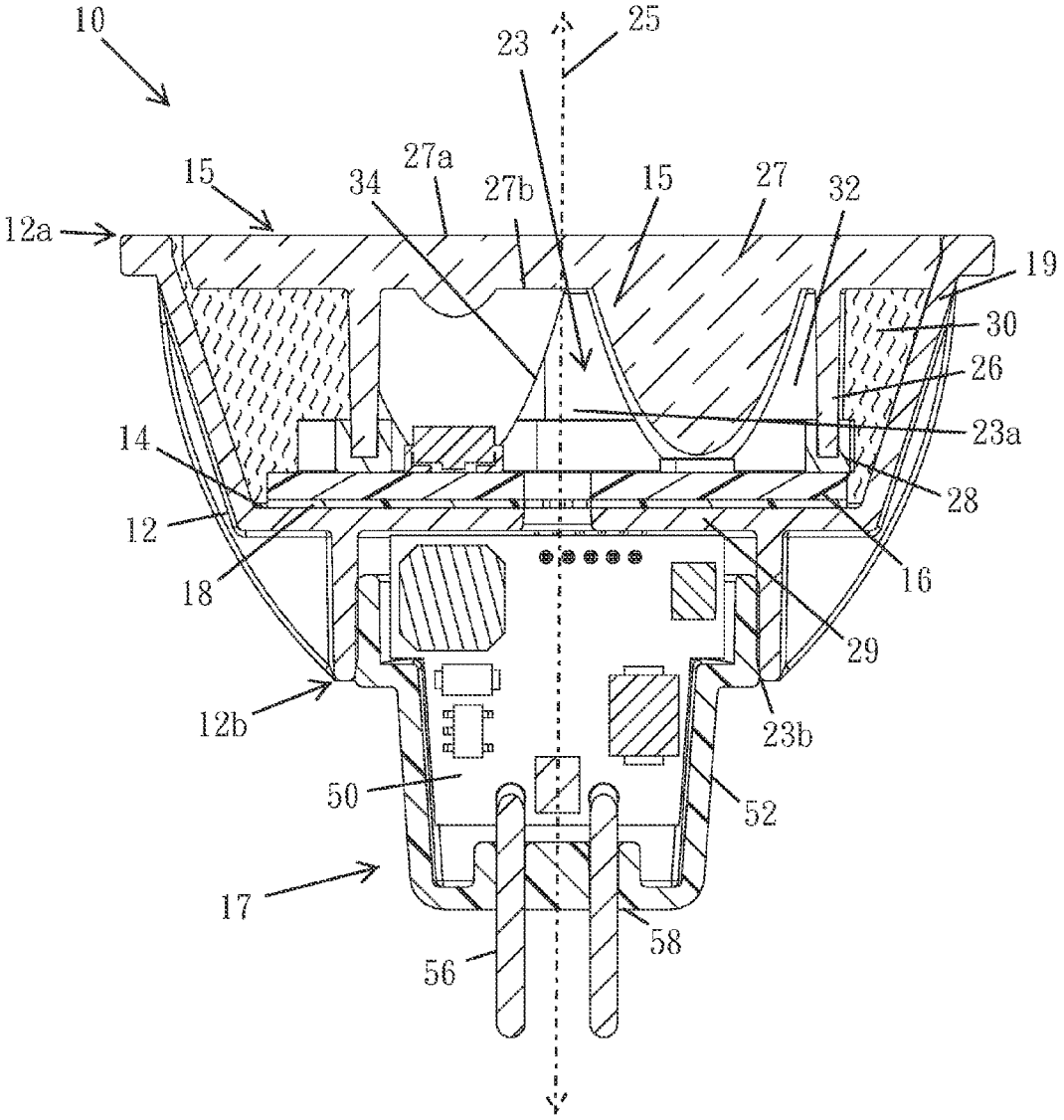
FIG. 5A illustrates a side cross-sectional view of the illuminating device of FIG. 1A along the cut plane 5A-5A of FIG. 1C

In some cases, the interior wall 29 separates the housing interior 23 into a first housing chamber 23*a* and a second housing chamber 23*b* (FIG. 5A). For example, the first housing chamber 23*a* can be the portion of the housing chamber 23 between the interior wall 29 and the first end 12*a* of the housing 12. The second housing 23*b* can be the portion of the housing chamber 23 between the interior wall 29 and the second 12*b* of the housing 12.

Moving now to FIGS. 4A-5B, the optics assembly 15 will be described. As illustrated, the optics assembly 15 can include a first portion 27 (e.g., a plate, lens, or other structure). The first portion 27 can have a generally planar shape. In some embodiments, the first portion 27 has an outer perimeter. The outer perimeter of the first portion 27 of the optics assembly 15 can generally match and/or complement an inner perimeter of the first opening 21*a* of the housing 12. In some embodiments, the outer perimeter of the first portion 27 of the optics assembly 15 is larger than the inner perimeter of the first opening 21*a* of the housing 12. The first portion 27 of the optics assembly 15 can have a first (e.g., external) surface 27*a* and a second (e.g., internal) surface 27*b* opposite the first surface 27*a* (FIG. 5A).

Figure 4A:
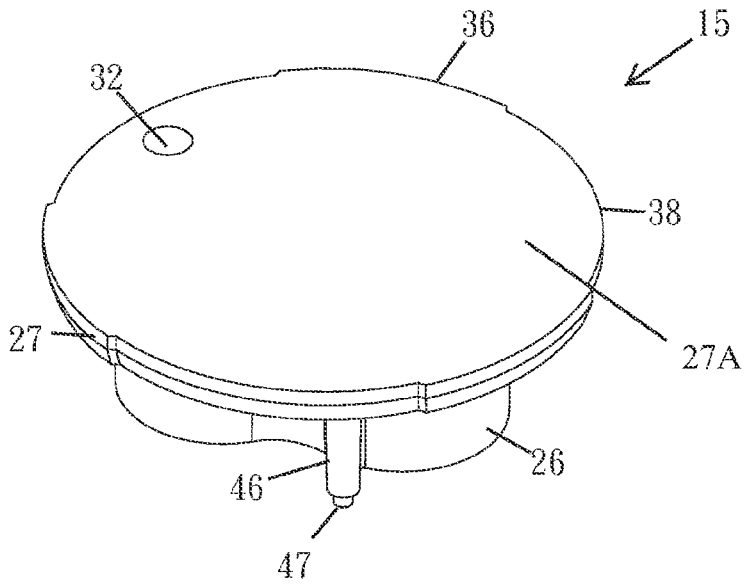
FIG. 4A illustrates an upper perspective view of an optics assembly of the illuminating device of FIG. 1A.
Figure 4B:
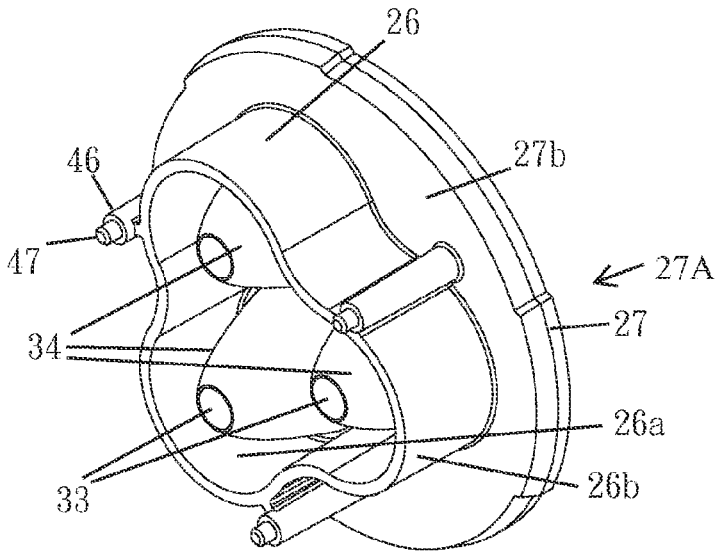
FIG. 4B illustrates a lower perspective view of the optics assembly of the illuminating device of FIG. 1A.
Figure 4C:
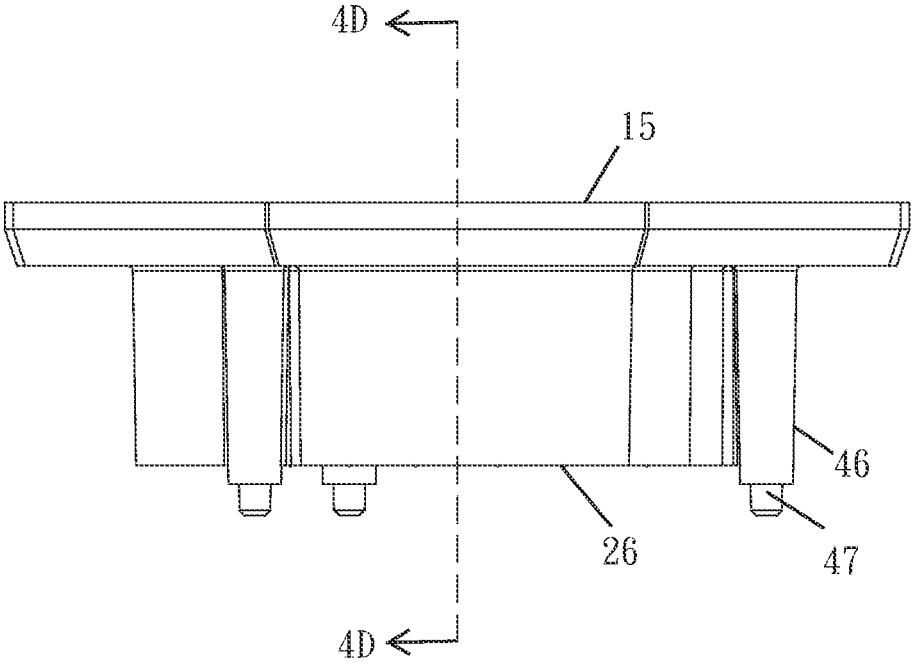
FIG. 4C illustrates a side view of the optics assembly of the illuminating device of FIG. 1A.
Figure 4D:
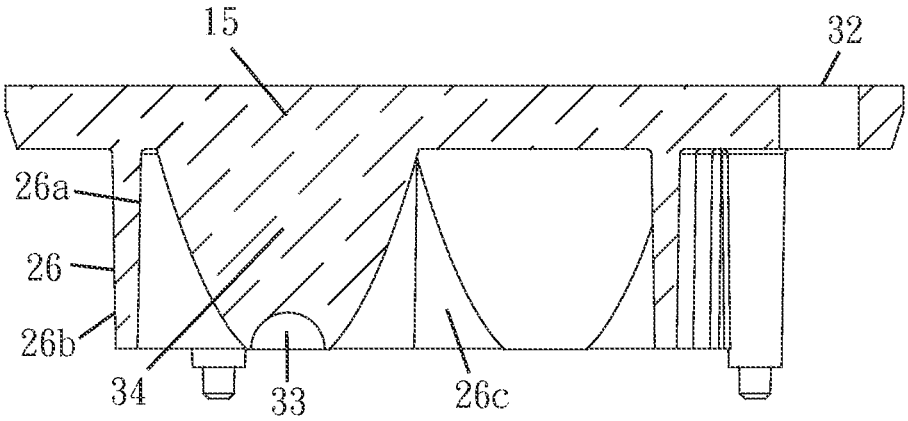
FIG. 4D illustrates a side cross-sectional view of the optics assembly of the illuminating device of FIG. 1A along the cut-plane 4D-4D of FIG. 4C.

The optics assembly 15 can include a skirt 26. For example, as illustrated in FIGS. 4B-4D, the optics assembly can include at least one skirt 26 (e.g., continuous wall) connected to and extending from the second surface 27*b* of the first portion 27 of the optics assembly 15. The skirt 26 can form a continuous and/or fluid-impervious wall along a predetermined skirt perimeter. The skirt perimeter can be sized and shaped to accommodate various components (e.g., light elements, lenses, circuitry) of the illuminating device 10. The skirt 26 can include an inner surface 26*a* and an outer surface 26*b*. The inner surface 26*a* of the skirt 26 can face away from the sidewall 19 of the housing 12 and the outer surface 26*b* of the skirt 26 can face toward the sidewall 19 of the housing 12 when the illuminating device 10 is assembled. The skirt 26 can include a skirt interior 26*c* at least partially defined by the inner surface 26*a* of the skirt 26.

In some embodiments, as illustrated in FIGS. 4B and 4D, the optics assembly 15 includes one or more lenses 34. Preferably, the optics assembly 15 includes three lenses 34, though fewer or more lenses may be used. The lenses 34 can be connected to the first portion 27 of the optics assembly 15. In some embodiments, the lenses 34 extend from the second surface 27*b* of the first portion 27 of the optics assembly 15. The one or more lenses 34 can be positioned at least partially within the skirt interior 26*c*. In some embodiments, the one or more lenses 34 are positioned entirely within the skirt interior 26*c*. In some cases, the skirt 26 may be a series of individual skirts, each skirt positioned to surround one or more lenses 34.

The lenses 34 can have any number of different shapes. As shown, the lenses can have a generally curved (e.g., elliptical) shape. For example, the one or more lenses 34 can taper and/or curve from a wider end nearest the first portion 27 of the optics assembly 15 to a narrower end furthest from the first portion 27.

Figure 5B:
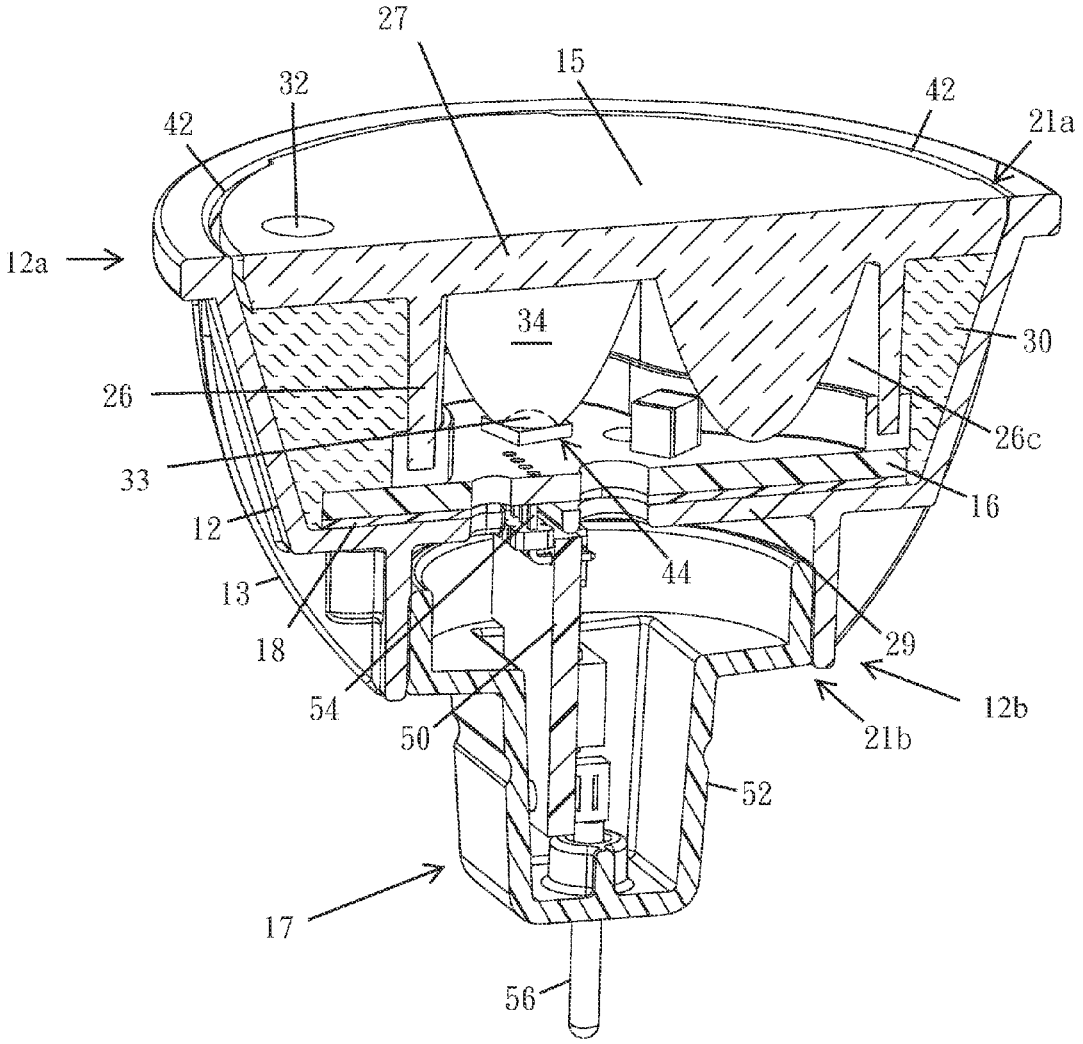
FIG. 5B illustrates a front cross-sectional view of the illuminating device of FIG. 1A along the cut plane 5B-5B of FIG. 1D.

The one or more lenses 34 can include cavities 33 formed in the end of the lenses 34 furthest from the first portion 27 of the optics assembly 15 (FIG. 4D). The lenses 34 can be aligned with and/or positioned adjacent to the light elements 44 when the illuminating device 10 is assembled. For example, as illustrated in FIG. 5B, the light elements 44 can fit at least partially within the cavities 33. Alignment between the lenses 34 and the light elements 44 can increase the likelihood of effective light distribution through the optics assembly 15 from the light elements 44.

Figure 6:
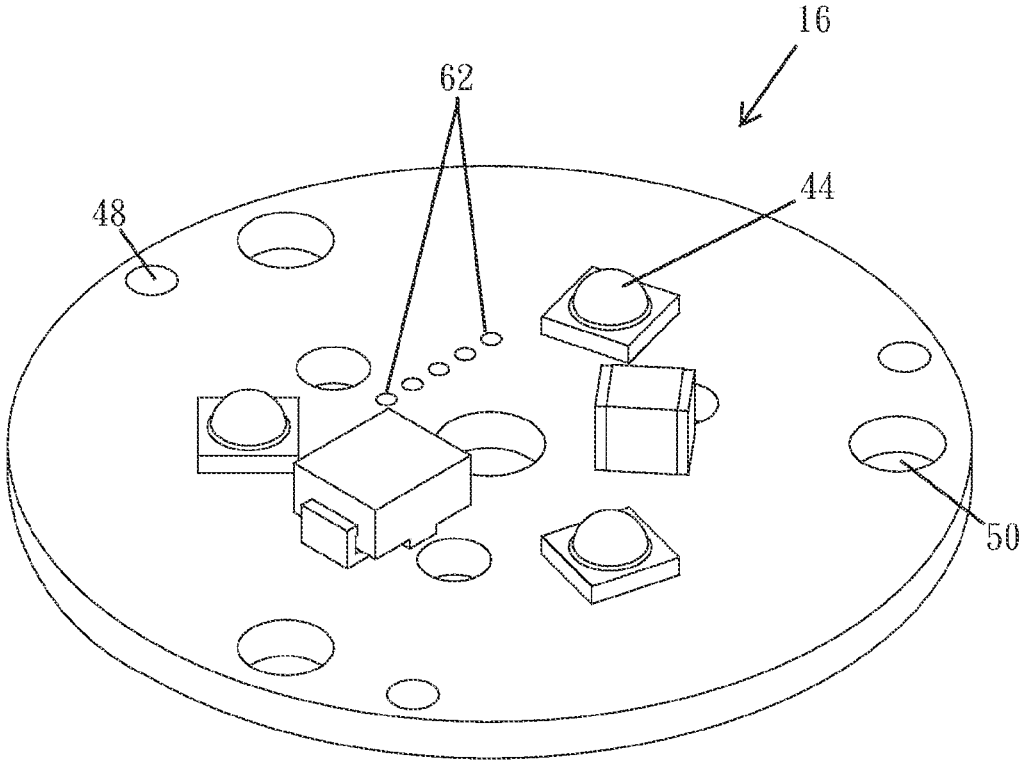
FIG. 6 is an upper perspective view of a circuit board of the illuminating device of FIG. 1A.

The optics assembly 15 can include one or more alignment structures. The one or more alignment structures can be configured to rotationally align (e.g., with respect to the axis 25 of the illuminating device 10) the lenses 34 with the light elements 44. In some embodiments, the alignment structures on the optics assembly 15 are configured to mate with corresponding alignment structure on the housing 12 or on some other component of the illuminating device 10. As illustrated in FIGS. 4A-4D, the alignment structures can include alignment posts 46 and/or alignment pins 47. The alignment pins 47 can be sized and shaped to mate with alignment holes 48 (FIG. 6) on the circuit board 16, the housing 12, or other structure. The alignment pins 47 can be circumferentially distributed in a uniform pattern on the optics assembly 15. In some embodiments, the alignment pins 47 are distributed in a non-uniform pattern on the optics assembly 15.

In some embodiments, the entire optics assembly 15 is formed (e.g., injection molded, milled, etc.) as a monolithic part. In some embodiments, two or more of the subcomponents of the optics assembly 15 are formed separately and later connected (e.g., adhered, welded, etc.). In some embodiments, the one or more optic lenses 34 can each be dropped into a separate holder in the housing interior 23, and the top lens(es) (e.g., first portion(s) 27) may be a separate part. In some cases the optic lens 34 may be formed form a clear plastic and the top lens 27 may be formed from glass. In some cases, the top lens 27 may be formed with one or more skirts projecting into the housing interior 23. In some cases one or more optic lenses 34 can be positioned within the one or more skirts. For example, each lens 34 may be positioned in a separate skirt. In some embodiments, the lenses 34 are distributed amongst separate skirts, with one or more of the skirts containing more than one lens 34. In some embodiments, one or more of the subcomponents of the optics assembly 15 are formed from a transparent or translucent material. For example, the entire optics assembly 15 can be formed from a transparent or translucent acrylic or other polymer, resin, or combination thereof.

Figure 7A:
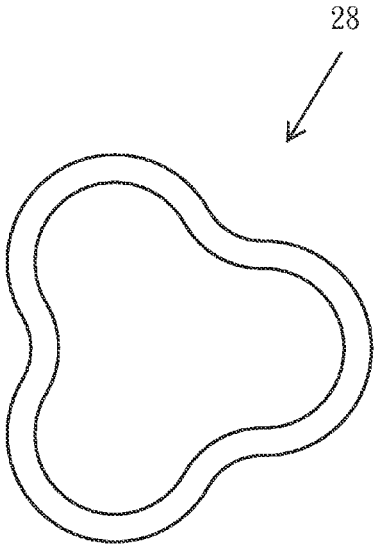
FIG. 7A is a bottom view of a gasket of the illuminating device of FIG. 1A.
Figure 7C:
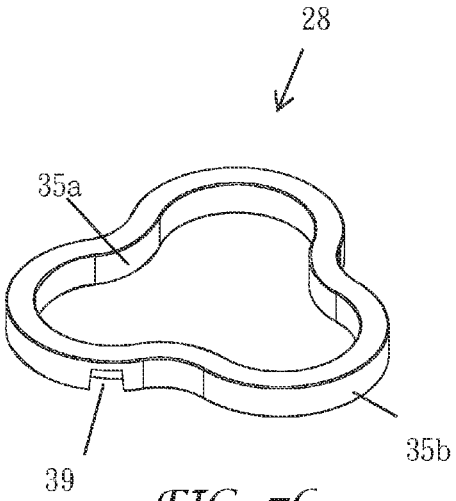
FIG. 7C is a lower perspective view of the gasket of the illuminating device of FIG. 1A.
Figure 7B:
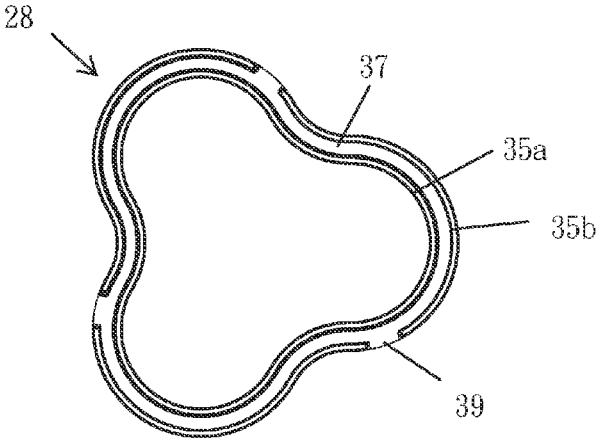
FIG. 7B is a top view of the gasket of the illuminating device of FIG. 1A.

The illuminating device 10 can include a gasket 28 or other sealing structure configured to engage with an end of the skirt 16 furthest from the first portion 27 of the optics assembly. As illustrated in FIGS. 7A-7C, the gasket 28 can include an inner wall 35*a* and an outer wall 35*b*. A channel 37 can be formed between the inner and outer walls 35*a*, 35*b* of the gasket. The channel 37 can be sized and shaped to receive a portion of the skirt 26. In some embodiments, the outer wall 35*b* of the gasket 28 includes one or more notches 39 configured to accommodate a portion of the alignment structure(s) of the optics assembly 15 (e.g., the alignment posts 46, alignment pins 47, or other alignment structure). The gasket 28 can be configured to form a liquid-tight and/or gas-tight seal with the skirt 16 and/or with the circuit board 16 when the illuminating device 10 is assembled. In some embodiments, as discussed in further detail below, the gasket 28 forms a seal with another portion (e.g., the mounting surface 14) of the housing 12. For example, the gasket 28 can be configured and positioned to form a seal between the skirt 16 and the interior wall 29, the sidewall 19 of the housing 12, the conductive pad 18, and/or some other surface or component of the illuminating device 10. The seal between the gasket 28 and a portion of the illuminating device 10 can form a water-tight (e.g., hermetic) seal that inhibits or prevents water from entering the skirt interior 26*c*. In some embodiments, the gasket 28 forms a sufficient seal such that the use of potting material or other additional sealant is not necessary. In some cases, potting material or other sealant is used as a seal to reduce the likelihood of moisture ingress into the skirt interior 26*c*. In some embodiments, the gasket 28 may be formed on the one or more skirts 26. In some cases, the formed gasket 28 may be co-molded to the skirt 26. In some embodiments, the gasket 28 may be a thinned section of the skirt 26 that can be flexible enough to create an adequate seal.

As illustrated in FIGS. 5A-5B, the power interface assembly 17 can be sized and shaped to connect with the second end 12*b* of the housing 12. In some embodiments, the power interface assembly 17 is sized and shaped to fit at least partially within the second opening 21*b* of the housing 12. For example, the interface housing 52 can be sized and shaped to fit at least partially within and connect to (e.g., friction fit with, be adhered to, be welded to) the second opening 21*b* of the housing 12 or to some other portion of the housing 12. Connection between the housing 52 of the power interface assembly 17 and the housing 12 can inhibit or prevent fluid passage through the second opening 21*b* of the housing 12 between the housing 12 and the housing 52 of the power interface assembly 17.

The power interface assembly 17 can include one or more contact pins 56. The contact pins 56 can be configured to electrically connect with a source of electricity (e.g., a socket, a light fixture, or a socket of a light fixture) to provide electric power to the illuminating device 10. In some embodiments, the illuminating device 10 is controlled by applying voltage to the contact pins 56. The voltage may be an AC line voltage. The voltage may be a low voltage (e.g., 12 VAC). In some cases, the light elements 44 may emit a white hue when illuminated. In some cases, as the voltage is applied to the illuminating device 10, the light elements 44 will illuminate. In some cases, control signals may be embedded into the AC voltage that can cause the light elements 44 to dim or brighten. The control signals may also cause the light elements 44 to turn on or off even though AC voltage is present. Illuminating devices of the present disclosure may respond to control signals similar to the type of control disclosed in U.S. Pat. No. 8,278,845 (filed on Sep. 26, 2011 as U.S. patent application Ser. No. 13/244,869 entitled SYSTEMS AND METHODS FOR PROVIDING POWER AND DATA TO LIGHTING DEVICES) or U.S. Pat. No. 8,773,030 (filed on Sep. 22, 2009 as U.S. patent application Ser. No. 12/564,840 entitled LOW VOLTAGE OUTDOOR LIGHTING POWER SOURCE AND CONTROL SYSTEM), both of which are incorporated by reference in their entirety herein. In some cases, the light elements 44 may each be a different color, or each light element 44 may be a multicolor light element. In some cases, a signal embedded onto the AC voltage may cause the light elements 44 to emit a color hue. In some cases, the illuminating device 10 may be able to change the colors of light emission based on a signal embedded in the AC voltage. This control signal may be similar to the control system disclosed in U.S.

application Ser. No. 14/700,961, filed Apr. 30, 2015 and published as U.S. Patent Pub. 2015/0237700 A1, entitled SYSTEMS AND METHODS TO CONTROL COLOR AND BRIGHTNESS OF LIGHTING DEVICES, the entirety of which is hereby incorporated by reference herein.

A method of assembling the illuminating device 10 can include mating the power interface assembly 17 to the housing 12. In some cases, the interface housing 52 is adhered to, welded to, friction fit to, or otherwise connected to the second opening 21*b* of the housing 12. Connection between the interface housing 52 and the housing 12 can be conducted in a fluid-tight or liquid-tight sealing manner. As illustrated in FIGS. 5A-5B, the control board 50 and/or other components of the power interface assembly 17 can be positioned at least partially within the housing interior 23 (e.g., in the second housing chamber 23*b*). In some cases, the area surrounding at least a portion of the control board 50 within the cavity of the interface housing 52 may be filled with potting material 30 or other sealing material to inhibit or prevent moisture that may damage the control board 50 from entering past the contact pins 56 or other areas surrounding the interface housing 52.

In some embodiments, the light assembly 31 is inserted into the housing interior 23 (e.g., into the first housing chamber 23*a*). The light assembly 31 can be adhered, welded, and/or otherwise connected to a portion of the housing 12 such as, for example, the mounting surface 14 of the interior wall 29.

The light assembly 31 can be connected to the power interface assembly 17. In some embodiments, the light assembly 31 includes one or more electrical or mechanical connections structures configured to connect to a corresponding structure of the power interface assembly 17. For example, the circuit board 16 can include a socket 62 configured to receive connector pins 54 of the control board 50. Connection between the socket 62 and pins 54 can facilitate transfer of electricity, control signals, and/or other information between the power interface assembly 17 and the light assembly 31 (e.g., via the control board 50). In some embodiments, the electronics of the power interface assembly 17 and the circuit board 16 can be mounted on a common circuit board. In some cases, the light elements 44 can be mounted to the common circuit board. In some cases, the light elements 44 may be mounted to the housing 12 and electrically connected to the common circuit board. In some cases the light elements 44 can be electrically connected to the common circuit board using wires. The common circuit board can be positioned within the first housing chamber 23*a*. In some embodiments, the common circuit board is positioned in the second housing chamber 23*b* (e.g., on an opposite side of the internal wall 29 from the light elements 44).

In some embodiments, the conductive pad 18 is positioned between the circuit board 16 and the power interface assembly 17. The conductive pad 18 can include adhesive configured to facilitate coupling between the pad 18 and a portion of the housing 12 (e.g., the mounting surface 14) and/or the circuit board 16. The conductive pad 18 can be configured to facilitate heat dissipation from the circuit board 16. In some embodiments, the conductive pad 18 and/or internal wall 29 include an aperture configured to permit passage of the pins 54 through the conductive pad 18 and/or internal wall 29. As illustrated in FIG. 2, one or more fasteners 20 can be inserted through the aperture 22 of the circuit board 16, through the conductive pad 18, and/or into the internal wall 29 (e.g., into the apertures 22) of the housing 12. The fasteners 20 can be used in addition to or instead of adhesives or welding to connect the light assembly 31 to other components of the illuminating device 10. In some cases, the conductive pad 18 may be larger than the circuit board 16 and the skirt 26. In some embodiments, the gasket 28 may contact the conductive pad 18 to create a seal.

The optics assembly 15 can be inserted at least partially into the housing 12. In some embodiments, the gasket 28 is positioned on the skirt 26 of the optics assembly 15 before inserting the optics assembly 15 into the housing 12. A pressure can be applied to the optics assembly 15 to compress the skirt 26 and/or gasket 28 against a portion of the housing 12 or light assembly 31. In some embodiments, the gasket 28 is compressed against the circuit board 16. Compression of the gasket 28 against the circuit board 16 can form a fluid-tight or liquid tight seal between the skirt 26 and the circuit board 16. In some embodiments, the gasket 28 is compressed against the internal wall 29 or some other portion of the housing 12 to form a seal. In some embodiments, the first portion 27 of the optics assembly 15 includes one or more flanges 36 configured to engage with a portion of the housing 12 (e.g., an inner rig surface 40 of the housing 12). Engagement between the first portion 27 of the optics assembly 15 and a portion of the housing 12 can help to ensure correct positioning (e.g., parallel to and/or perpendicular to the axis 25) of the optics assembly 15 with respect to the housing 12.

A potting material 30 (FIG. 5A) can be injected through a fill hole 32 of the first portion 27 of the optics assembly 15 (FIG. 5B) when the optics assembly 15 is positioned at least partially within the housing 12. In some embodiments, the potting material 30 is injected through a hole or other access point positioned elsewhere on the illuminating device 10. For example, one or more injections access points can be positioned in the sidewall 19 of the housing 12. The injection access point(s) can form interface(s) between the space between the skirt and the sidewall and an exterior of the illuminating device. The optics assembly 15 can include one or more vents 42 to facilitate removal of displaced air from the housing 12 as the potting material 30 is injected through the fill hole 32. For example, one or more radial reliefs 38 or cuts can be included on an outer perimeter of the first portion 27 of the optics assembly 15. In some embodiments, the radial reliefs 38 create a gap between the first portion 27 of the optics assembly 15 and the sidewall 19 of the housing 12, permitting air passage between the first portion 27 of the optics assembly 15 and an inner surface of the housing 12 (e.g., a surface near the first end 12*a* of the housing 12). In some cases, one or more vents are positioned though the sidewall 19.

The potting material 30 can be configured to form a seal (e.g., a fluid-tight or liquid-tight seal) between an exterior of the skirt interior 26*c* and the ambient environment. In some embodiments, the potting material 30 is configured to act as an adhesive bond between the optics assembly 15 and the housing 12. The potting material 30 can be a silicon material or some other appropriate material. In some embodiments, the potting material 30 is an opaque or substantially opaque material. In some embodiments, the sealing provided by the potting material 30 inhibits or prevents moisture access to the circuit board 16 and other components of the light assembly 31. This sealing can be performed without injection of potting material 30 into the skirt interior 26*c*. As illustrated in FIG. 5B, the potting material 30 can be maintained in the space between the skirt 26 and the sidewall 19 of the housing 12. The combination of the potting material 30, the skirt 26, the gasket 28, the circuit board 16, the conductive pad 18, the internal wall 29, the interface housing 52, and/or the pings 56 can maintain a fluid-tight sealed chamber to protect the light elements 44 and other internal components of the illuminating device 10 from moisture and other environmental hazards.

In some such cases, the lenses 34 and other components of the optics assembly 15 are permitted to operate as total internal reflection lenses without optical interference from the potting material 30. In some embodiments, a lens is attached to the housing 12 and the skirt 26 provides protection from the environmental elements that may damage the one or more light elements 44, without the addition of a potting compound. In some cases, a seal may be used in conjunction with the skirt 26 to protect the one or more light elements 44 without the addition of a potting compound.

In some embodiments, an illuminating device comprises a housing having a first end, a second end, and one or more sidewalls defining a housing interior. The illuminating device can include an optics assembly connected to the housing at near the first end of the housing. The optics assembly can include a first portion having a first side and a second side. The optics assembly can include a skirt connected to the first portion and extending from the second side of the first portion, the skirt having an interior surface defining a skirt interior and an outer surface facing the one or more sidewalls of the housing. In some configurations, the optics assembly includes one or more lenses connected to the first portion and extending from the second side of the first portion at least partially within the skirt interior, each of the one or more lenses having a first end and a second end positioned further from the first portion of the optics assembly than the first end of the one or more lenses. The illuminating device can include a circuit board positioned within the housing interior and including at least one light element positioned within the housing interior adjacent the first end of the one or more lenses. In some embodiments, the illuminating device includes a potting material. In some embodiments, the skirt is connected to one or both of the circuit board and the one or more sidewalls. One or more sealing elements (e.g., gaskets, pads, O-rings) can be positioned between the skirt and the circuit board/sidewall. In some embodiments, the skirt 26 may seal against a flexible pad (not shown). In some such embodiments, the flexible pad may be a heat conductive pad. In some cases, the potting material is positioned between the outer surface of the skirt and the one or more sidewalls to prevent water ingress into the skirt interior. In some cases, no potting material is positioned within the skirt interior. Positioning potting material outside of the skirt interior between the skirt and the sidewalls of the housing can help to inhibit or prevent ingress of water to the skirt interior from the ambient environment.

According to some variants, an illuminating device can include a housing having a first end, a second end, and one or more sidewalls defining a housing interior. The device can include at least one light element positioned within the housing interior. In some embodiments, the device includes an optics assembly connected to the first end of the housing. The optics assembly can have an outer face. In some embodiments, the optics assembly has at least one lens extending from the outer face into the housing interior and having a first end opposite the outer face that is adjacent the at least one light element, the at least one lens configured to allow light from the at least one light element to pass therethrough. In some embodiments, the optics assembly includes a skirt extending from the outer face into the housing interior and surrounding the at least one lens, the skirt having an interior surface defining a skirt interior and an outer surface facing the one or more sidewalls of the housing. The device can include a potting material positioned between the outer surface of the skirt and the one or more sidewalls to prevent water ingress into the skirt interior, and wherein no potting material is positioned within the skirt interior.

For expository purposes, the term "horizontal" as used herein is defined as a plane parallel to the plane or surface of the floor of the area in which the device being described is used or the method being described is performed, regardless of its orientation. The term "floor" floor can be interchanged with the term "ground." The term "vertical" refers to a direction perpendicular to the horizontal as just defined. Terms such as "above," "below," "bottom," "top," "side," "higher," "lower," "upper," "over," and "under," are defined with respect to the horizontal plane.

As used herein, the terms "attached," "connected," "mated," and other such relational terms should be construed, unless otherwise noted, to include removable, moveable, fixed, adjustable, and/or releasable connections or attachments. The connections/attachments can include direct connections and/or connections having intermediate structure between the two components discussed.

The terms "approximately", "about", "generally" and "substantially" as used herein represent an amount close to the stated amount that still performs a desired function or achieves a desired result. For example, the terms "approximately", "about", "generally," and "substantially" may refer to an amount that is within less than 10% of the stated amount.

While the preferred embodiments of the present disclosure have been described above, it should be understood that they have been presented by way of example only, and not of limitation. It will be apparent to persons skilled in the relevant art that various changes in form and detail can be made therein without departing from the spirit and scope of the disclosure. Thus the present disclosure should not be limited by the above-described exemplary embodiments, but should be defined only in accordance with the following claims and their equivalents. Furthermore, while certain advantages of the disclosed embodiments have been described herein, it is to be understood that not necessarily all such advantages may be achieved in accordance with any particular embodiment. Thus, for example, those skilled in the art will recognize that the embodiments may be embodied or carried out in a manner that achieves or optimizes one advantage or group of advantages as taught herein without necessarily achieving other advantages as may be taught or suggested herein.

What is claimed is:

1. An illuminating device comprising:

a housing having a first end, a second end, and one or more sidewalls defining a housing interior;

an optics assembly connected to the housing at near the first end of the housing and having:

a first portion having a first side and a second side;

a skirt connected to the first portion and extending from the second side of the first portion, the skirt having an interior surface defining a skirt interior and an outer surface facing the one or more sidewalls of the housing; and one or more lenses, at least one of the one or more lenses positioned at least partially within the skirt interior, each of the one or more lenses having a first end and a second end positioned further from the first portion of the optics assembly than the first end of the one or more lenses;

a light assembly positioned at least partially within the housing interior, the light assembly having:

a circuit board positioned within housing interior; and at least one light element operably connected to the circuit board and positioned within the housing interior adjacent the first end of the one or more lenses; and a potting material;

wherein the skirt is connected to one or both of the circuit board and the one or more sidewalls, wherein the potting material is positioned between the outer surface of the skirt and the one or more sidewalls to prevent water ingress into the skirt interior, wherein no potting material is positioned within the skirt interior, and wherein the first portion of the optics assembly includes a fill hole through which the potting material can be injected between the outer surface of the skirt and the one or more sidewalls.

2. The illuminating device of claim 1, comprising a plurality of lenses, wherein each of the plurality of lenses is positioned within the skirt interior.

3. The illuminating device of claim 1, comprising a second skirt connected to the first portion and extending from the second side of the first portion, the second skirt having an interior surface defining a skirt interior and an outer surface facing the one or more sidewalls of the housing, wherein at least a second one of the one or more lenses is positioned within the skirt interior of the second skirt.

4. The illuminating device of claim 1, wherein the optics assembly comprises one or more alignment structures configured to mate with a corresponding alignment on a component of the illuminating device.

5. The illuminating device of claim 4, wherein circuit board includes one or more alignment structures configured to couple with the one or more alignment structures of the optics assembly.

6. The illuminating device of claim 5, wherein the one or more alignment structures of the optics assembly comprises pins and the one or more alignment structures of the circuit board comprises holes configured to receive the pins of the optics assembly.

7. The illuminating device of claim 1, comprising one or more vents configured to facilitate egress of displaced air from between the outer surface of the skirt and the one or more sidewalls as potting material is injected between the outer surface of the skirt and the one or more sidewalls.

8. The illuminating device of claim 1, wherein the at least one light element is mounted on the circuit board.

9. The illuminating device of claim 1, wherein the housing includes an internal wall separating the housing interior into a first housing chamber and a second housing chamber, wherein the at least light element is positioned in the first housing chamber and the circuit board is positioned in the second housing chamber.

10. The illuminating device of claim 1, comprising a control board configured operably connected to the circuit board and to a source of power.

11. An illuminating device comprising:

a housing having a first end, a second end, and one or more sidewalls defining a housing interior;

at least one light element positioned within the housing interior;

an optics assembly connected to the first end of the housing and having:

an outer face;

at least one lens extending from the outer face into the housing interior and having a first end opposite the outer face that is adjacent the at least one light element, the at least one lens configured to allow light from the at least one light element to pass therethrough; and a skirt extending from the outer face into the housing interior and surrounding the at least one lens, the skirt having an interior surface defining a skirt interior and an outer surface facing the one or more sidewalls of the housing;

potting material positioned between the outer surface of the skirt and the one or more sidewalls to prevent water ingress into the skirt interior; and at least one aperture through one or both of the outer face of the optics assembly and one or more sidewalls of the housing through which the potting material may be introduced; wherein no potting material is positioned within the skirt interior.

12. The illuminating device of claim 11, wherein the optics assembly is a monolithic part constructed from a transparent or translucent material.

13. The illuminating device of claim 11, wherein the potting material is an opaque material.

14. The illuminating device of claim 11, comprising a power interface assembly coupled with the housing, the power interface assembly having:

an interface housing; and one or more contact pins positioned at least partially within the interface housing and configured to connect to a source of power.

15. An illuminating device comprising:

a housing having a first end, a second end, and one or more sidewalls defining a housing interior;

at least one light element positioned within the housing interior;

an optics assembly positioned at least partially within the housing interior and having:

an outer face;

at least one lens positioned adjacent the at least one light element, the at least one lens configured to allow light from the at least one light element to pass therethrough; and a skirt extending from the outer face into the housing interior and surrounding the at least one lens, the skirt having an interior surface defining a skirt interior and an outer surface facing the one or more sidewalls of the housing;

a sealing structure connected to the skirt; and at least one fill hole through which potting material can be injected into a space between the outer surface of the skirt and the one or more sidewalls of the housing;

wherein:

the sealing structure forms a seal between the skirt and another structure of the illuminating device; and no potting material is positioned within the skirt interior.

16. The illuminating device of claim 15, wherein the at least one lens is positioned between the at least one light element and the outer surface of the optics assembly.

17. The illuminating device of claim 15, wherein the sealing structure forms a hermetic seal between skirt and another structure of the illuminating device to inhibit or prevent fluid ingress into the skirt interior.

18. The illuminating device of claim 15, wherein the sealing structure forms a hermetic seal between the skirt and a circuit board.

19. The illuminating device of claim 15, wherein the housing includes one or more fins configured to increase the convective area of the housing to dissipate heat to an ambient environment.

20. The illuminating device of claim 15, comprising one or more vents configured to facilitate egress of displaced air from between the outer surface of the skirt and the one or more sidewalls as potting material is injected between the outer surface of the skirt and the one or more sidewalls.

* * * * *